US006808078B2

(12) United States Patent
Ta

(10) Patent No.: US 6,808,078 B2
(45) Date of Patent: Oct. 26, 2004

(54) SPIRAL TIE AND ACCESSORY RACK WITH STACKED POLE SEGMENTS

(76) Inventor: Thien Q. Ta, 12691 Saint Mark St., Garden Grove, CA (US) 92845

( * ) Notice: Subject to any disclaimer, the term of this patent is extended or adjusted under 35 U.S.C. 154(b) by 103 days.

(21) Appl. No.: 10/206,762

(22) Filed: Jul. 29, 2002

(65) Prior Publication Data

US 2002/0190016 A1 Dec. 19, 2002

Related U.S. Application Data

(63) Continuation of application No. 09/488,929, filed on Jan. 21, 2000, now Pat. No. 6,425,490.
(60) Provisional application No. 60/116,914, filed on Jan. 22, 1999.

(51) Int. Cl.[7] ..... A47B 5/08
(52) U.S. Cl. ..... 211/116; 211/116; 211/13.1; 211/96
(58) Field of Search ..... 211/116, 115, 211/95, 96, 163, 205, 13.1; D23/378, 381, 411; 416/100, 110

(56) References Cited

U.S. PATENT DOCUMENTS

| | | | | | |
|---|---|---|---|---|---|
| 831,510 | A | * | 9/1906 | Heimann | 211/119 |
| 1,681,614 | A | * | 8/1928 | Hubinger | 211/6 |
| 1,948,014 | A | * | 2/1934 | Tuttle | 211/115 |
| D91,717 | S | * | 3/1934 | Maguire | D6/462 |
| 2,613,931 | A | * | 10/1952 | Singer | 472/7 |
| 3,133,643 | A | * | 5/1964 | Lester | 211/116 |
| 3,195,736 | A | * | 7/1965 | Bomar, Jr. | 211/163 |
| 3,315,819 | A | * | 4/1967 | Kingsery | 211/163 |
| 3,872,973 | A | * | 3/1975 | Duncan | 211/115 |
| 5,074,445 | A | * | 12/1991 | Chen | 223/85 |
| D326,786 | S | * | 6/1992 | McLeod | D6/468 |
| D341,652 | S | * | 11/1993 | Marino | D23/378 |
| 5,303,827 | A | * | 4/1994 | Ross | 211/85.15 |
| D348,079 | S | * | 6/1994 | Bogen | D19/75 |
| 5,437,378 | A | * | 8/1995 | Ta | 211/115 |
| 5,480,075 | A | * | 1/1996 | Robinson | 223/88 |
| 5,492,237 | A | * | 2/1996 | Chang | 211/202 |
| 5,772,050 | A | * | 6/1998 | Shih | 211/39 |
| 5,839,586 | A | * | 11/1998 | Smith | 211/163 |
| 5,996,819 | A | * | 12/1999 | Klein | 211/85.14 |
| 6,425,490 | B1 | * | 7/2002 | Ta | 211/116 |

* cited by examiner

*Primary Examiner*—Leslie A. Braun
*Assistant Examiner*—Khoa Tran
(74) *Attorney, Agent, or Firm*—David A. Testardi

(57) ABSTRACT

A spiral tie and accessory rack includes an elongate supporting member that defines both a curved hook portion for supporting the rack from a closet rod and a downwardly extending straight core portion for rotatably receiving and supporting a plurality of annular pole segments thereon. The pole segments each carry at least one support arm and are provided with interlocking, angularly phase-shifted male and female features on their lower and upper surfaces, respectively. When the pole segments are properly stacked around the core portion so as to be mated to one another, the tie support arms are arranged to spiral around the inner supporting member. The rack may be supplied in kit form, and may also be converted to a table-top (standing) rack or a wall-mounted rack.

19 Claims, 16 Drawing Sheets

FIG. 9
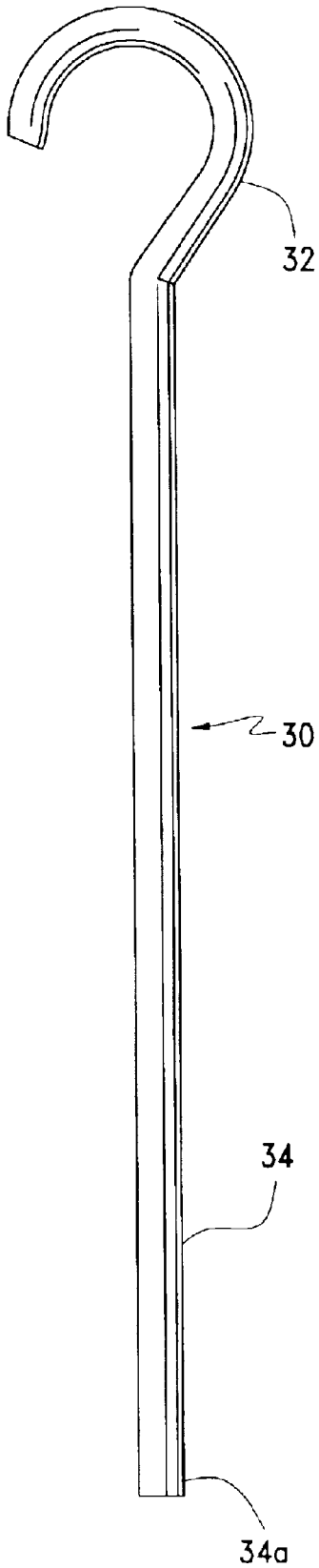
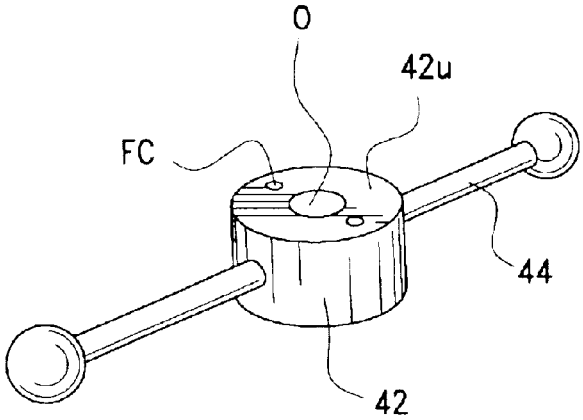
FIG. 5
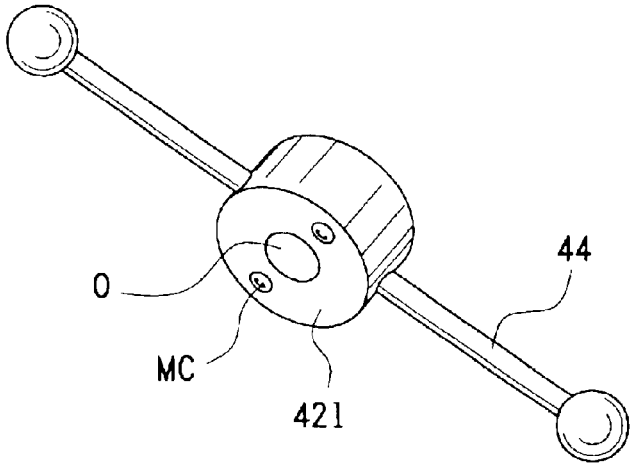
FIG. 6

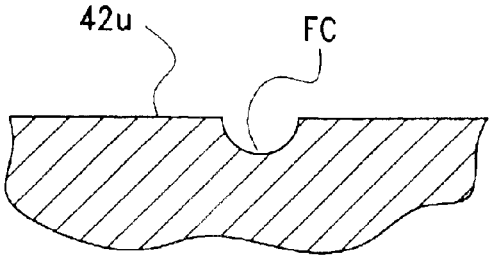
FIG. 7a
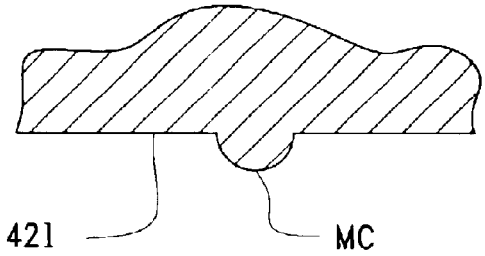
FIG. 7b
FIG. 8
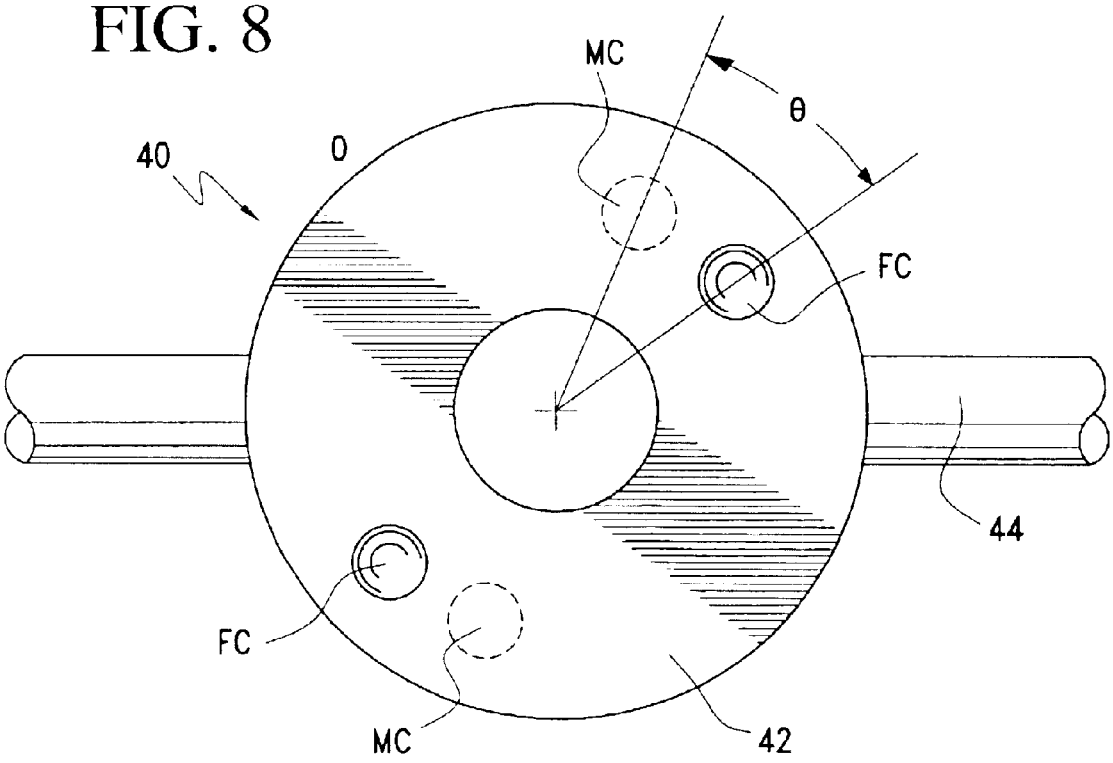

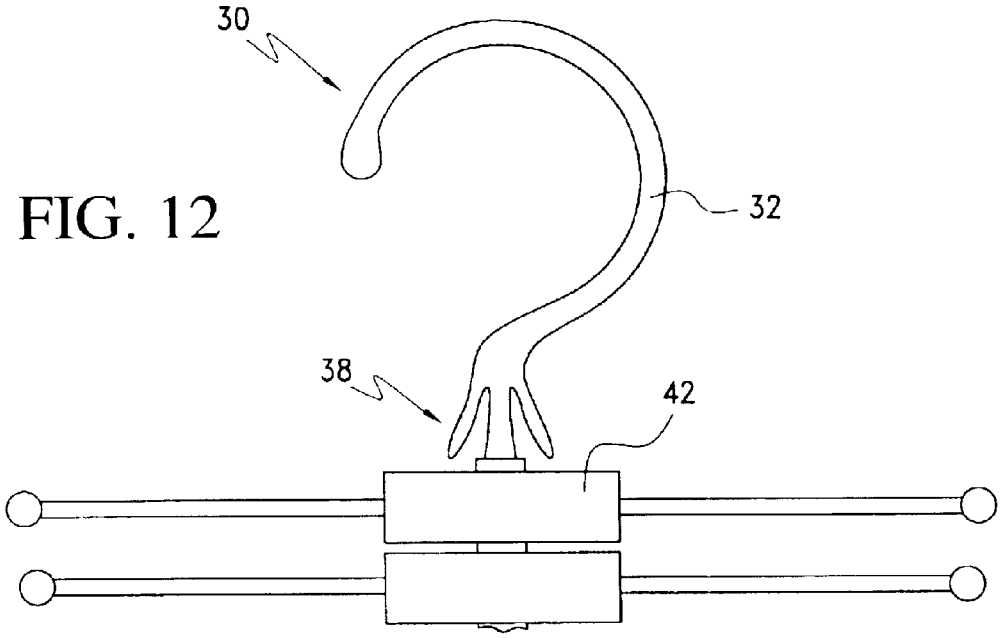
FIG. 12
FIG. 11
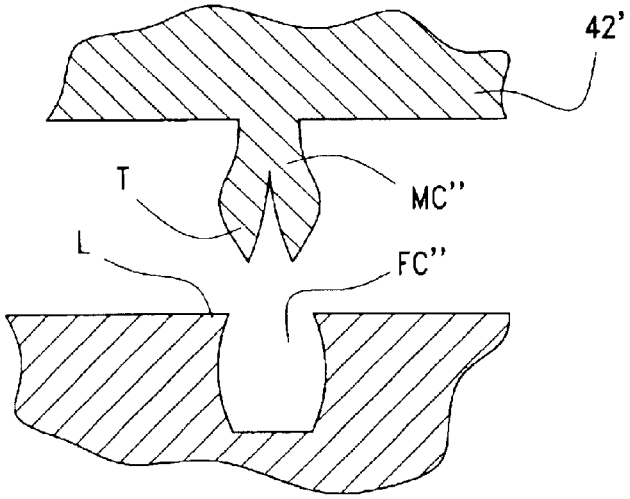
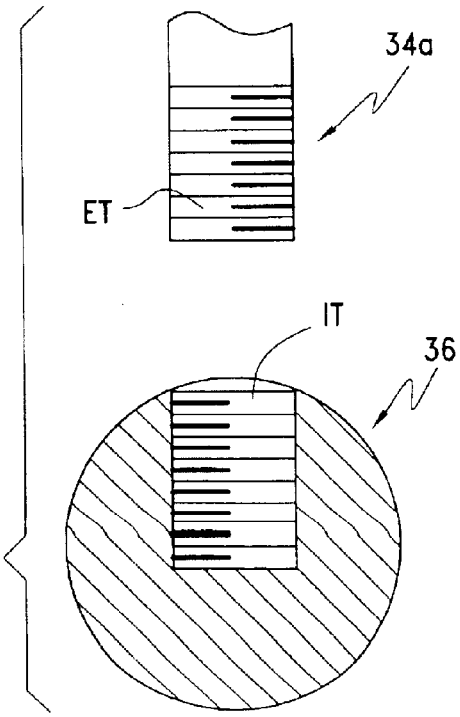
FIG. 13

FIG. 17a
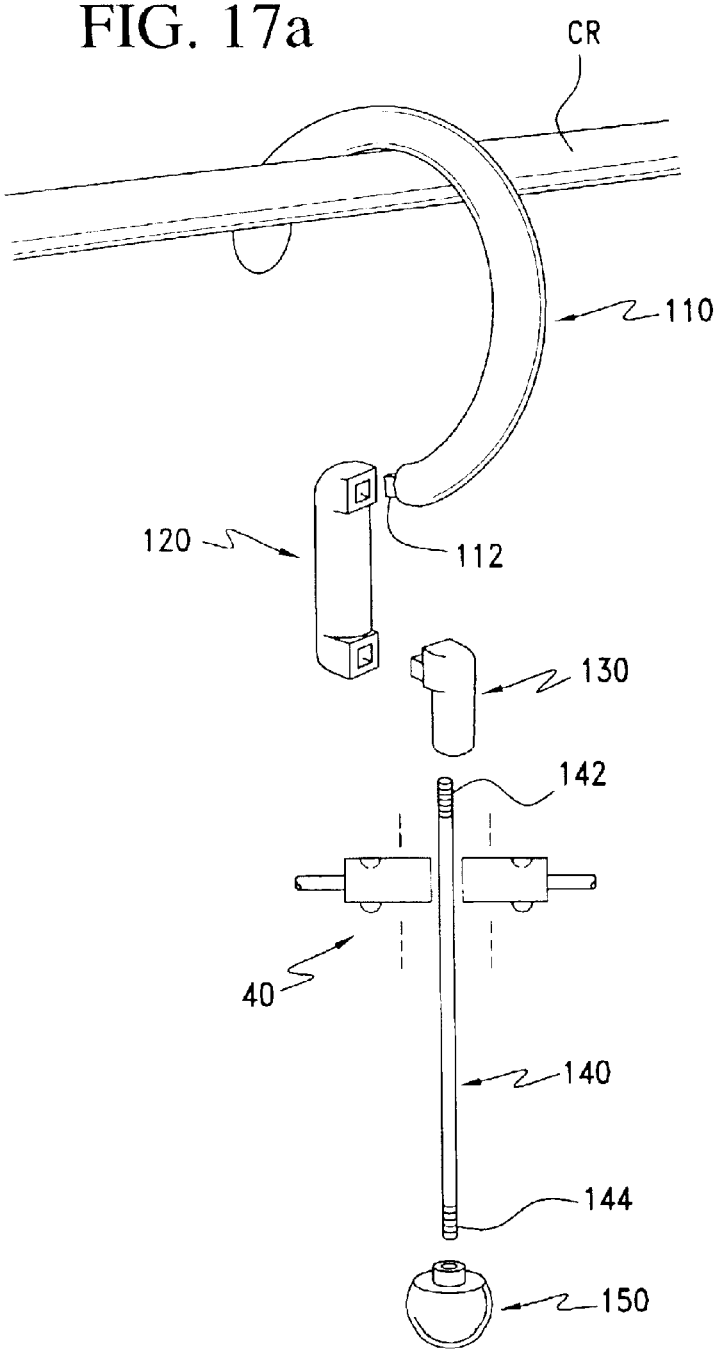
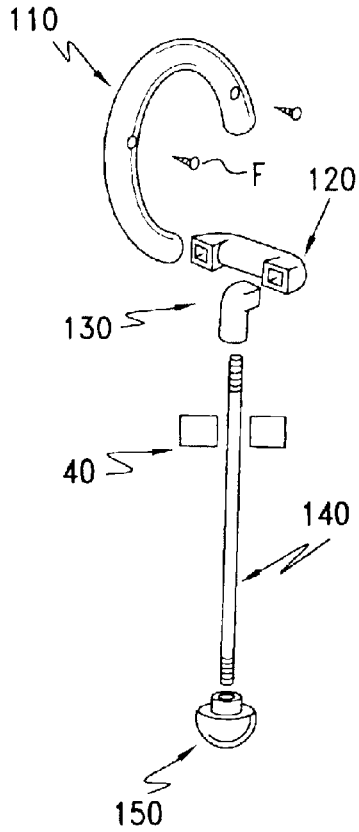
FIG. 17b

FIG. 18a
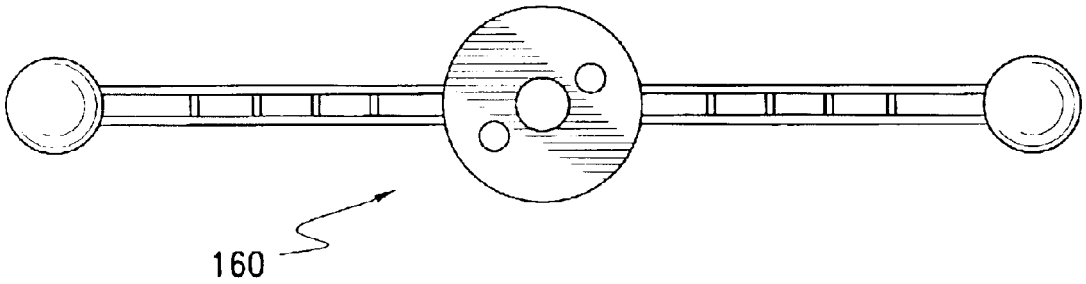
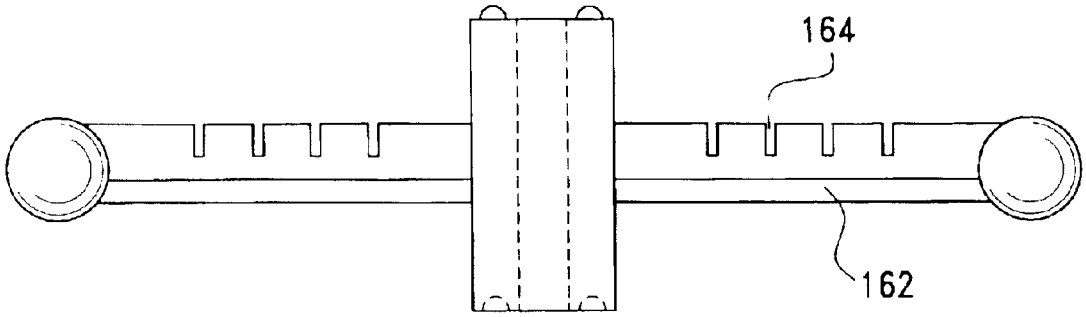
FIG. 18b

SPIRAL TIE AND ACCESSORY RACK WITH STACKED POLE SEGMENTS

CROSS-REFERENCE TO RELATED APPLICATION

This application is a continuing application of U.S. patent application Ser. No. 09/488,929, filed on Jan. 21, 2000, issuing on Jul. 30, 2002 as U.S. Pat. No. 6,425,490. This application claims the benefit of U.S. Provisional Application No. 60/116,914, filed on Jan. 22, 1999.

BACKGROUND OF THE INVENTION

1. Field of the Invention

The present invention pertains to the field of apparel and accessory hangers. More particularly, the present invention pertains to the field of hanging racks which are adapted to simultaneously suspend a plurality of ties or belts, and to the field of standing racks which are adapted to simultaneously suspend a plurality of jewelry items.

2. Description of the Related Art

A prior art spiral tie rack is shown in my previous U.S. Pat. No. 5,437,378, the disclosure of which is incorporated by reference herein. In an exemplary embodiment of the '378 patent, the rack includes a central pole defining a periphery and having first and second axial ends, a hook, rotatable connection means for connecting the hook to the first end of the central pole in a relatively rotatable manner, and apparel supporting means for supporting a plurality of apparel items at circumferentially spaced positions around the central pole. The apparel supporting means include a plurality of support arms rigidly connected to the periphery of the central pole. The support arms are arranged so as to spiral at least partly around the central pole between the first and second axial ends thereof.

The related art is also shown in U.S. Pat. Nos. 4,141,453, 3,872,973, 2,459,417, 1,926,636, 1,308,253, 831,510, 338, 288, and German published Application DE 3339740 A1, all of which are incorporated by reference herein. In particular, the '453 patent shows an earring display rack having a plurality of outwardly extending spokes with notches formed therein. The '973 patent shows a hanging rack for neckties in which a plurality of hanger members are mounted and retained in stacked relation on a straight vertical portion of a support rod. The '417 patent shows a necktie rack which may be alternately supported on a shelf or a rod. The '636 patent shows a bracket supported rack having revolvably mounted arms which can be used to display neckties. The '253 patent reveals a holder which can be alternately supported by a floor or joist, or by other horizontal or overhead supports. The '510 patent reveals a display fixture which may be alternately configured to hang from a rod or to stand on a tripod. The '288 patent shows a clothes drier which can be removably secured to a stove-top. The '740 published application shows a hanging decoration with stacked support segments that can swivel and lock at predetermined angular positions.

SUMMARY OF THE INVENTION

It is an object of the present invention to provide a spiral rack which facilitates quick and easy access to any one of a plurality of personal accessories such as ties, belts, or other items of apparel or jewelry.

It is another object of the invention to provide a spiral tie and accessory rack which facilitates manufacture by combining a plurality of substantially identical pole segments to form a unitary central pole structure which carries personal accessory support arms and which is rotatably carried by an elongate supporting core.

It is another object of the invention to provide a spiral tie and accessory rack which is convertible between a hanging configuration and a table top configuration.

In one respect the invention relates to a rack for supporting personal accessories. The rack includes: a base ring having a coupling member at one end thereof; a middle connector having a first end provided with a first coupling member that mates with the coupling member of the base ring, and a second end provided with a second coupling member; an endpiece connector having a first end provided with a coupling member that mates with the second coupling member of the middle connector, and a second end provided with a core receiving portion; an elongate core having a first end received and held by the core receiving portion of the endpiece connector, and a second end; a plurality of annular pole segments, each of the pole segments carrying at least one personal accessory support arm that includes a free end, wherein the pole segments are rotatably received on the elongate core in a stacked manner; a stop member connected to the second end of the elongate core in such a manner that the pole segments are disposed on the elongate core between the endpiece connector and the stop member; and interlocking means, provided on the pole segments, for rotationally interlocking the pole segments together in a such a manner that the free ends of the personal accessory support arms spiral at least partly around the elongate core.

In another respect the invention relates to a rack which includes: a base ring; an elongate core; connecting means interconnecting the base ring and the elongate core; and a plurality of annular pole segments, each of the pole segments carrying two diametrically opposed personal accessory support arms that each include a free end, wherein the pole segments are rotatably received on the elongate core in a stacked manner so that the free ends of the support arms spiral at least partly around the elongate core; and wherein the rack is configured as a standing rack which is supported on the base ring, and wherein the elongate core extends upwardly from the base ring.

In yet another respect, the invention relates to a rack which includes: a base ring; an elongate core; connecting means interconnecting the base ring and the elongate core; and a plurality of annular pole segments, each of the pole segments carrying at least one personal accessory support arm that includes a free end, wherein the pole segments are rotatably received on the elongate core in a stacked manner so that the free ends of the support arms spiral at least partly around the elongate core; and wherein the rack is configured as a convertible rack which is adapted to be supported by the base ring in a plurality of mounting configurations selected from the group consisting of a standing configuration, a rod mounting configuration, and a wall-mounting configuration.

The invention will, however, be best understood by a review of the following specification in conjunction with the accompanying drawings in which:

BRIEF DESCRIPTION OF THE DRAWINGS

FIG. 5 reveals a top view of one of the pole segments of the spiral tie rack according to the first preferred embodiment of the invention;

FIG. 6 reveals a bottom view of one of the pole segments of the spiral tie rack according to the first preferred embodiment of the invention;

FIG. 7*a* reveals a partial cross-section of a female interlocking feature provided on the upper surface of the pole segments according to the first preferred embodiment of the invention;

FIG. 7*b* reveals a partial cross-section of a male interlocking feature provided on the lower surface of the pole segments according to the first preferred embodiment of the invention;

FIG. 8 reveals a top view of a pole segment according to the first preferred embodiment of the invention showing the angular phase-shift between the female interlocking features on the upper surface of the pole segment and the male interlocking features on the lower surface of the pole segment;

FIG. 9 reveals an elongate supporting member having a curved hook portion and a substantially straight downwardly extending core portion according to the first preferred embodiment of the invention;

FIG. 11 reveals two adjacent pole segments according to a third preferred embodiment of the invention which include complementary interlocking features in the form of axially acting snap-connections which function to inhibit the axial separation of the adjacent pole segments;

FIG. 12 reveals an elongate supporting member according to a fourth embodiment of the invention which includes at least one flexible one-way extension provided on the elongate supporting member adjacent a base part of the curved hook portion;

FIG. 13 reveals a manner in which the radially extending stop is removably fixed to a lower part of the core portion so as to permit loading of the pole segments onto the core portion by temporarily removing the stop;

FIGS. 17*a* and 17*b* reveal the BRC system configured for a hanging and wall-mounted spiral rack embodiments, respectively;

FIGS. 18*a* and 18*b* reveal top and frontal views of a stackable pole segment with jewelry support arms;

DETAILED DESCRIPTION OF THE PREFERRED EMBODIMENTS

Figure 1:
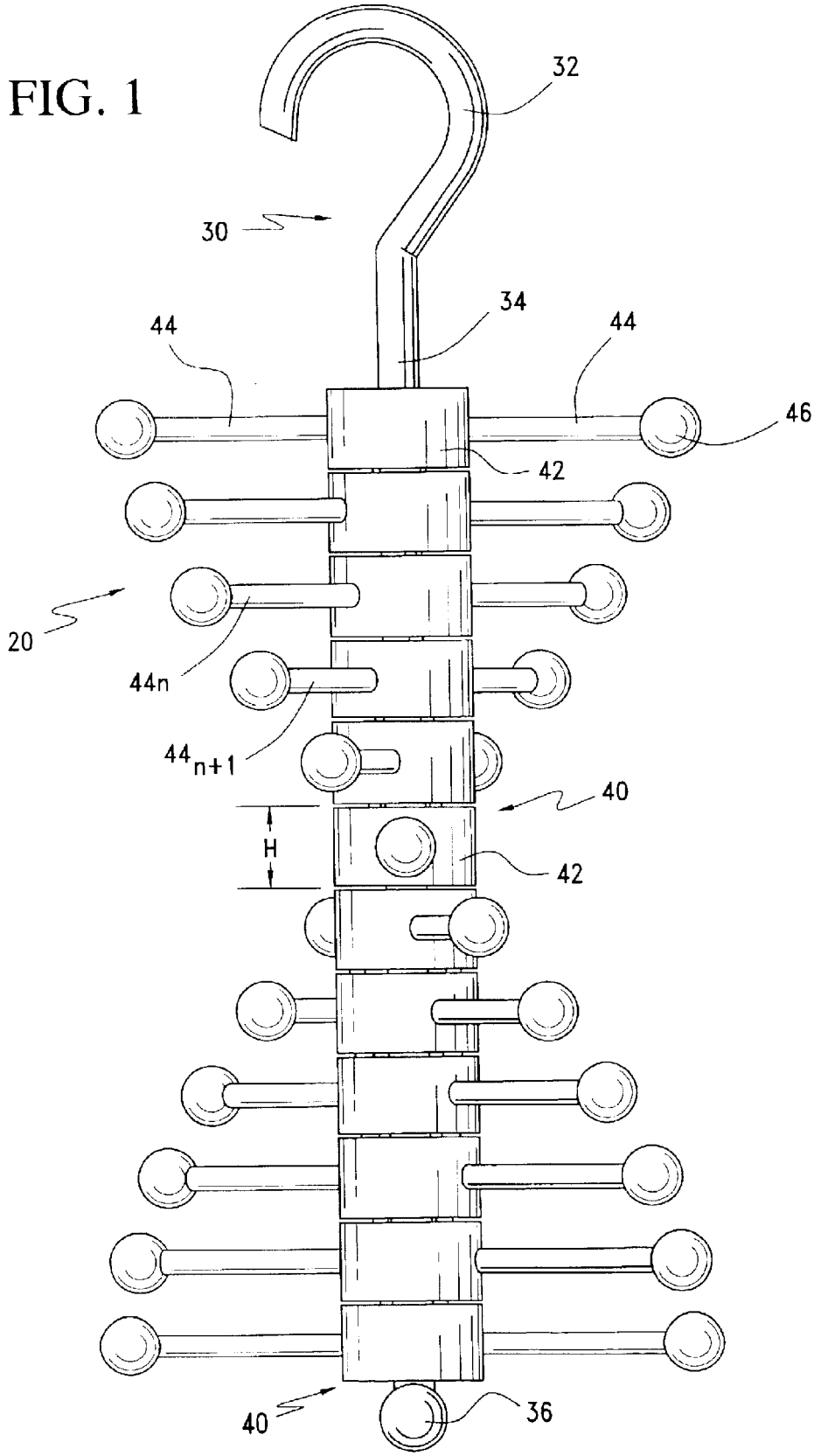
FIG. 1 reveals a frontal view of a spiral tie rack according to a first preferred embodiment of the invention.
Figure 3:
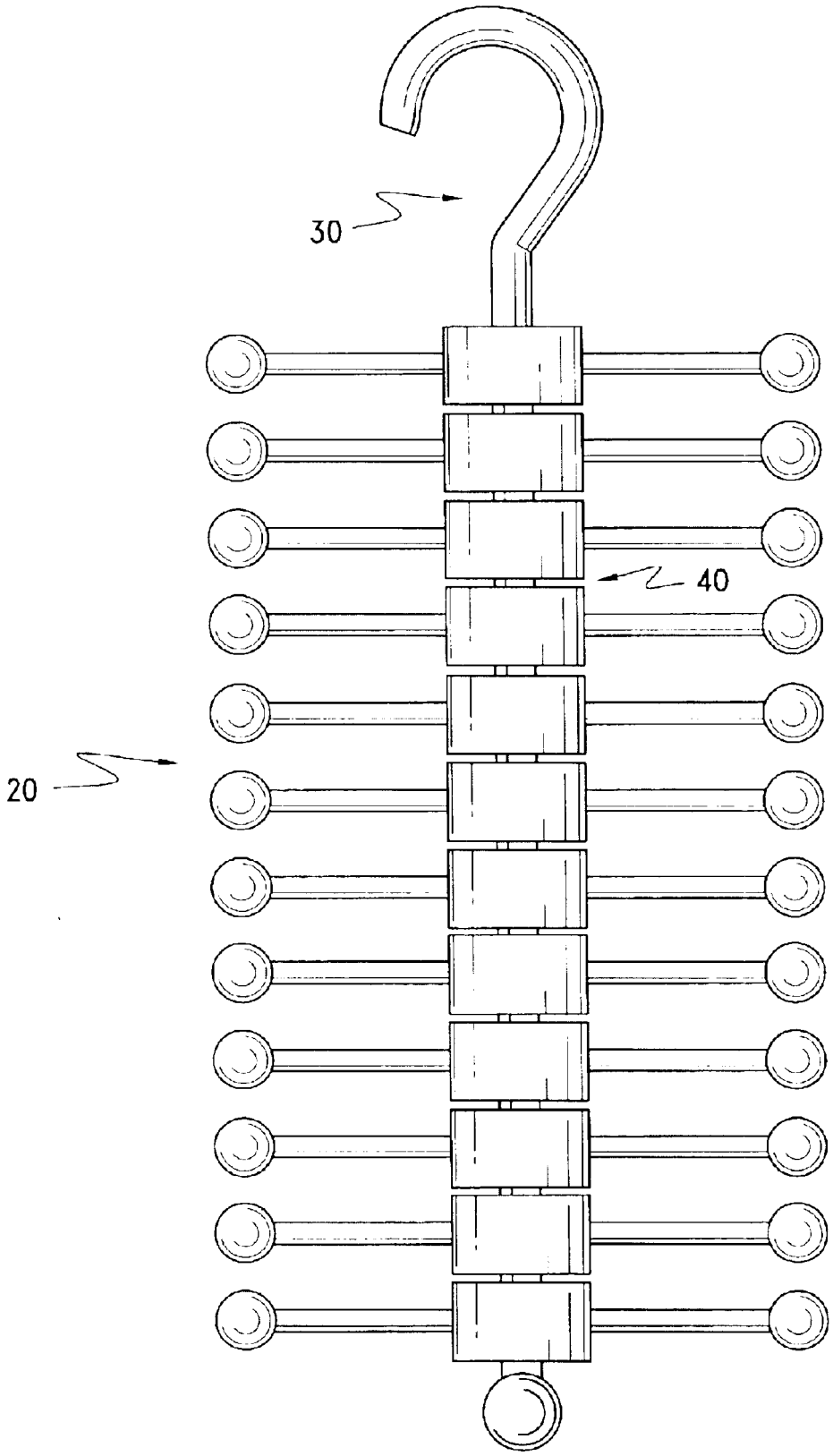
FIG. 3 reveals a frontal view of the spiral tie rack according to the first preferred embodiment of the invention when the pole segment are separated so that the apparel support arms lie flat for packaging.

Referring now to the drawings in which like reference characters indicate like elements throughout, there is shown in FIGS. 1, 3, and 5 to 10*b* a spiral rack 20 according to a first preferred embodiment of the invention. As shown in FIGS. 1 and 3, the rack includes which includes an elongate supporting member 30 that carries a plurality of (e.g. 12) stacked, substantially identical pole segments 40 thereon. The elongate supporting member 30 (which is preferably molded from substantially rigid plastic, but which can comprise any other suitable substantially rigid engineering material such as wood or metal) includes a curved hook portion or hook 32 (that functions as a top mounting portion) which is joined to a downwardly extending, substantially straight, circularly cylindrical core portion or core 34 (that defines the central axis of the spiral rack) and terminates at a radially extending stop 36.

As shown in FIG. 9, the curved hook portion 32 is preferably (but not necessarily; cf. FIG. 17*a*) formed integrally with the core portion 34. The radially extending stop 36 preferably takes the shape of an enlarged (i.e. having a greater diameter than the diameter of the core portion 34), substantially spherical bulb which is formed as one piece with or joined (such as by chemical bonding, friction locking, and/or form locking e.g. screw threads) to the core portion 34 at a lower part 34*a* (FIG. 9) thereof, although in certain cases, the radially extending stop 36 may take other shapes. In any event, the radially extending stop 36 is part of the elongate supporting member 30 and functions as a means for supporting the pole segments 40 when the spiral rack 20 is in its upright position.

Each of the pole segments 40 is preferably made from the same material as the elongate supporting member 30 and includes an annular body portion 42 which surrounds (or substantially surrounds) the core portion 34 and at least one apparel support arm 44 (such as a tie support arm) or personal accessory support arm 44 (if the rack is also to be used for other personal accessories such as belts, watches or jewelry) which extends generally or substantially radially outwardly from the annular body portion 42 and which terminates at an enlarged, substantially spherical free end 46. (The function of the enlarged, substantially spherical free end 46 is to prevent accidental removal of ties or other personal accessory items from the rack.) Preferably, each of the pole segments 40 includes two, diametrically opposed personal accessory support arms 44 (so named because they are intended to removably support personal accessories when the rack is used) which extend substantially radially outwardly from the annular body portion 42. According to the first preferred embodiment of the invention, all of the pole segments 40 are identically or substantially identically molded from plastic using either one set or a plurality of substantially identical sets of molding dies.

As shown in FIGS. 1, 5, 6, and 8, the annular body portion 42 of each pole segments 40 is preferably formed as a complete ring (i.e. 360 degrees) having a height H and defining a central opening O (having a diameter larger than the diameter of the core portion 34) for receiving the core portion 34 of the elongate supporting member 30, although partial rings (i.e. less than 360 degrees) are also envisioned for the present invention. Each annular body portion 42 includes an upper facing (substantially planar) annular surface 42*u* and a lower facing (substantially planar) annular surface 42*l*. As shown in FIGS. 5 to 8, at least one (e.g. two) female coupling part FC (e.g. in the form of substantially hemispherical, circular or rectangular cylindrical, cubic, or other appropriately shaped recesses) is/are formed at the upper surface 42*u* of each annular body portion 42, and at least one (e.g. two) male coupling part MC (e.g. in the form of substantially hemispherical, circular or rectangular cylindrical, cubic, or other appropriately shaped projections) is/are formed at the lower surface 42*l* of each annular body portion. The male and female coupling parts MC, FC define complementary interlocking features for rotatably interlocking the pole segments together with each other to form a unitary stack, as will be explained hereinafter.

As shown in FIG. 8, the angular position(s)/orientation(s) of the female coupling part(s) FC on the upper surface 42*u* of each annular body portion 42 is (are) phase-shifted by a predetermined angle θ relative to the angular position(s)/orientation(s) of the male coupling part(s) on the lower surface 42*l* of the same annular body portion 42. This angle θ defines the angular interval between adjacent apparel support arms 44 in the spiral rack, such as the apparel support arms $\mathbf{44}_n$, $\mathbf{44}_{n+1}$ in FIG. 1. According to the first preferred embodiment of the invention, this angle θ (in degrees) is selected according to the equation:

$$\theta=360/(N_S \cdot N_A),$$

where $N_S$ is the number of pole segments in the spiral rack and $N_A$ is the number of apparel support arms carried by each pole segments. Thus in the first preferred embodiment of the invention, θ is approximately 15 degrees. (It will be understood, however, that other techniques may be used to select an appropriate angle θ for other styles of spiral racks. Additionally, the direction of the angular interval defined by the angle θ can be selected to produce either a clockwise or counter-clockwise spiralling of the apparel support arms 44 down the core portion 34 of the elongate supporting member 30, as may be desired.)

The manner in which the spiral rack according to the first embodiment of the present invention is assembled will now be explained with reference to the following assembly descriptions.

Figure 10A:
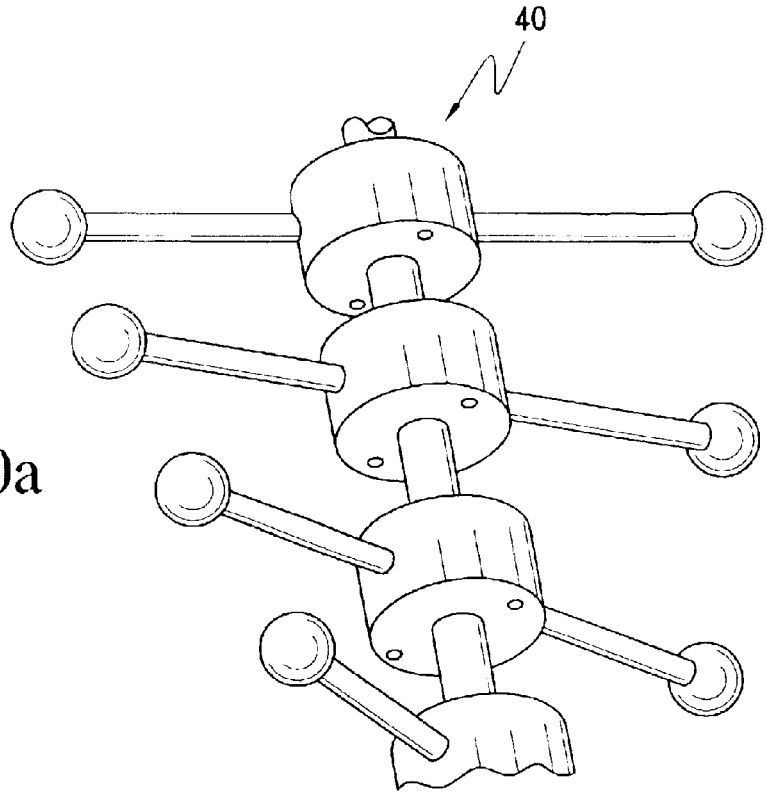
FIGS. 10*a* and 10*b* reveal a method by which the pole segments can be arranged on the core portion according to the first preferred embodiment of the invention in the case where the spiral rack is provided in a disassembled kit form.
Figure 10B:
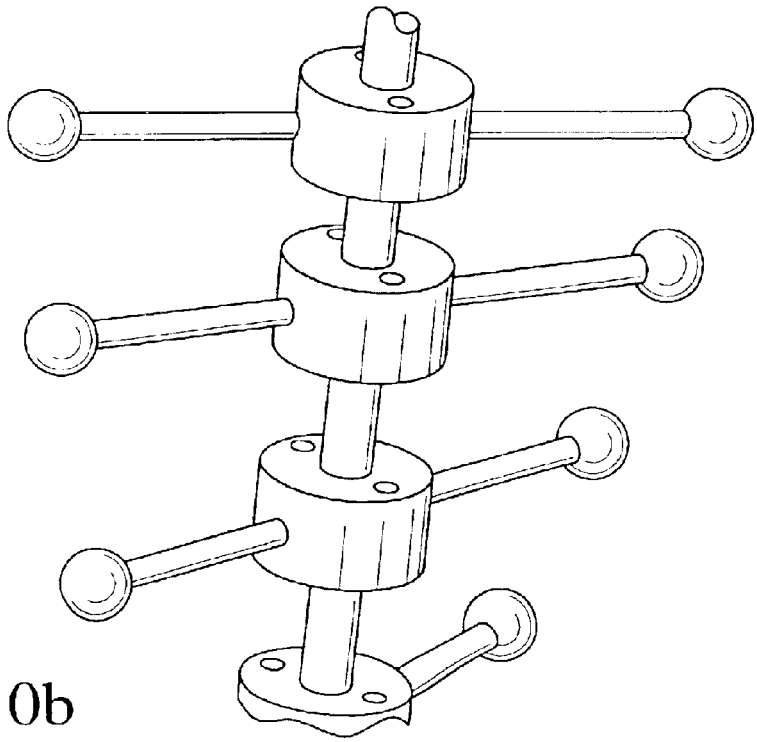

In the case where the radially extending stop 36 is formed as one piece with or permanently joined (e.g. by chemical bonding adhesives or the like) to the lower part 34*a* of the core portion 34 (or formed integrally therewith), the diameter of the central openings O of the pole segments 40, the heights H of the pole segments, and the diameter and shape of the curved hook portion 32 and the core portion 34 are selected so that the pole segments 40 can be slipped around the curved hook portion 32 and received on the core portion 34 from the top (see FIGS. 1, 10*a*, and 10*b*). Once the first (e.g. bottommost) pole segment 40 is received on the core portion 34, it rests on the radially extending stop 36. Additional pole segments 40 are then received and positioned on the core portion 34 so as to each rest and react on the pole segment which lies beneath it in the stack, with the male coupling parts MC of each overlying pole segment 40 being rotationally arranged to engage and rotationally interlock with the corresponding female coupling parts FC of each underlying pole segment 40. Thus, any two adjacent pole segments 40 (i.e. an overlying pole segment 40 which engages and rotationally interlocks with an underlying pole segment 40) form a pair of rotationally interlocked adjacent pole segments, and a pole segment 40 in the middle of the stack is engaged and rotationally interlocked with both the pole segment above it and the pole segment below it by means of the interlocking male and female coupling parts MC, FC (i.e. the pole segment 40 in the middle of the stack can be said to be a part of two pole segment pairs). As a consequence, all of the pole segments 40 are rotationally coupled together (e.g. under the influence of gravity) to form, in essence, a unitary central pole structure (or a unitary stack of pole segments) which is rotatably mounted around the core portion 34. (As used herein, the term "interlocking" means a positive bi-directional rotational coupling; that is, the male and female coupling parts MC, FC positively engage each other to resist both clockwise and counterclockwise relative rotation between adjacent pole segments 40.)

Continuing with the assembly descriptions, in the case where the radially extending stop 36 is removably joined to the lower part 34*a* of the core portion 34 (e.g. by means of cooperating external screw threads provided at or adjacent the lower part 34*a* of the core portion 34 and internal screw threads provided in a recess in the radially extending stop 36), then assembly may be made from the bottom of the core portion 34 by removing the radially extending stop 36, inverting the core portion 34, slipping the pole segments 40 onto the inverted core portion, reattaching the radially extending stop 36, and then turning the whole assembly right-side-up. The pole segments may then be rotationally manipulated to ensure that the male coupling parts MC of each overlying pole segment 40 in the stack are properly engaged and rotationally interlocked with the female coupling parts FC of each underlying pole segment 40, whereby a unitary central pole structure (or a unitary stack of pole segments) may be formed which is rotatably mounted around the core portion 34.

Accordingly, it will be seen that the male and female coupling parts MC, FC of the annular pole segments cooperate in such a manner that the apparel support arms of adjacent pairs $\mathbf{44}_n$, $\mathbf{44}_{n+1}$ of the stacked annular pole segments are angularly phase-shifted relative to each other, and that the free ends 46 of the apparel support arms 44 are arranged so as to define at least one portion of at least one substantially helical curve. (As used herein, a "helical curve" is only to be defined by the free ends of at least three support arms which are circumferentially spaced and axially staggered so as to lie generally on a helix, with the free ends of at least two adjacent ones of the three support arms not being circumferentially spaced by more than approximately 60 degrees relative to the axis of the rack.) That is, the free ends of one or more groups of the apparel support arms are arranged to spiral down around an imaginary central axis of the core portion 34 of the elongate supporting member 30. In the first preferred embodiment of the invention, since each pole segment 40 carries two apparel support arms, there are two groups of apparel support arms which each spiral down the core portion 34 of the elongate supporting member 30. In this respect, it is noted that the various and diverse manners in which the apparel support arms may be angularly arranged so that their free ends spiral (or form substantially helical curves) around an axis of a central member of a spiral rack has been particularly pointed out in my previous U.S. Pat. No. 5,437,378 (which is incorporated by reference herein). In the interest of brevity, the reader is expressly directed to that U.S. Patent for teachings concerning this and other aspects of spiral racks, which can be applied to the preferred embodiments of the invention disclosed herein.

In use, the spiral rack according to the first preferred embodiment of the invention is hung, by means of the curved hook portion 32, from a horizontal closet rod (not shown) or like structure, and individual ties (and/or other personal accessory items such as belts, watches or jewelry) are draped around the respective apparel support arms 44. When it is desired, for example, to view or select ties disposed at a distant side of the spiral rack, the entire stack of pole segments 40 may be rotated as a unit (e.g. by rotating the lowermost pole segment or by turning the lowermost apparel support arms) so as to bring the distant side of the rack to a frontal position.

For packaging the spiral tie rack according to the first preferred embodiment of the invention, the spiral rack may be lain so that the elongate supporting member 30 is disposed horizontally. Now, in the absence of a gravitational force in the direction of the central axis of the core portion 34, the pole segments 40 can be separated from each other (so that the male and female coupling parts MC, FC are disengaged) and thereafter rotated so that all the apparel support arms 44 are also disposed horizontally. Of course, it is not necessary to package the spiral rack according to the first embodiment of the invention in such a collapsed fashion; the spiral rack could also be packaged in full spiral form.

Alternatively, the spiral rack according to the first embodiment of the invention may be packaged and sold as a kit. In this case, one elongate supporting member 30 (including e.g. a fixed or removable radially extending stop 36) is packaged with a requisite number (e.g. 12) of pole segments, and assembly instructions are included in the package for communicating a manner in which the annular pole segments may be rotatably received on the core portion and interlockingly stacked one on top of another above the stop to produce a rack in which the apparel support arms spiral around the core portion. These instructions include text similar to (or substantially identical in procedural content to) one or more of the assembly descriptions given above.

Figure 2:
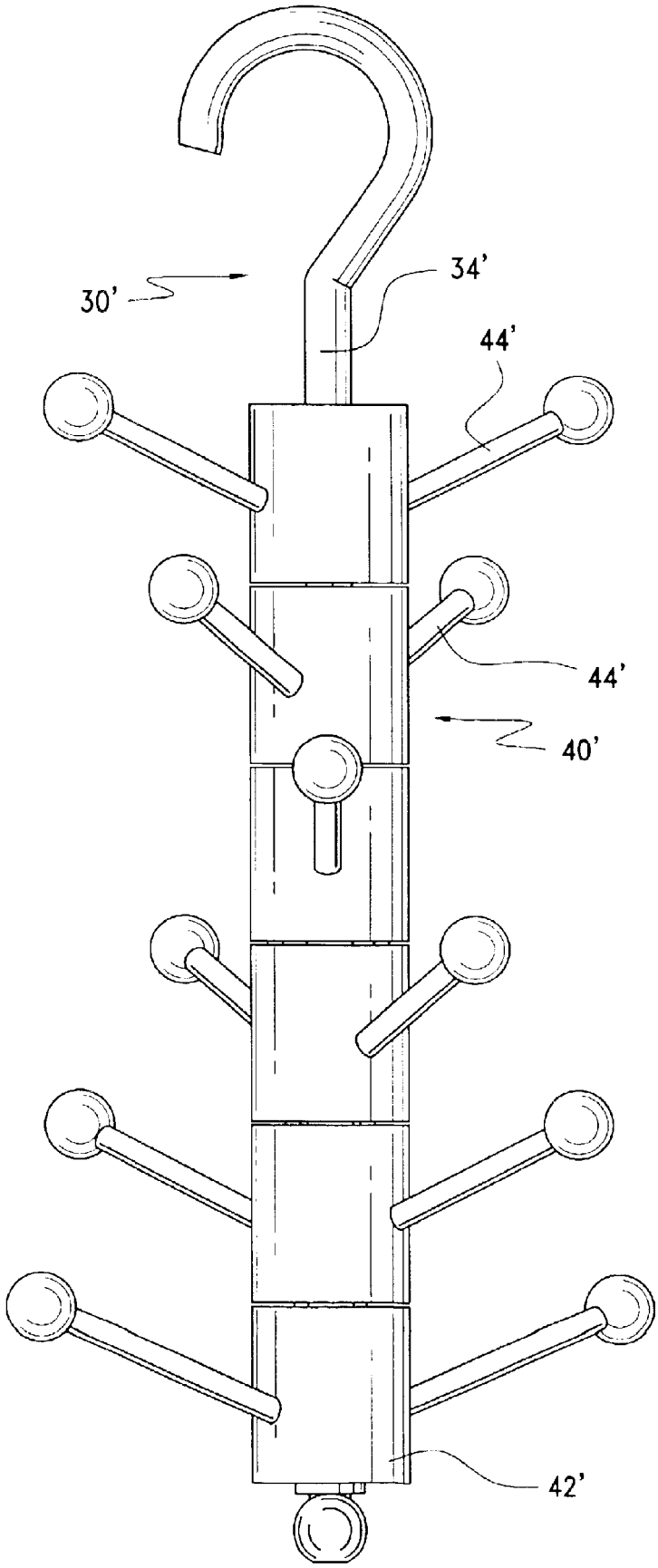
FIG. 2 reveals a frontal view of a spiral tie rack according to a second preferred embodiment of the invention.
Figure 4:
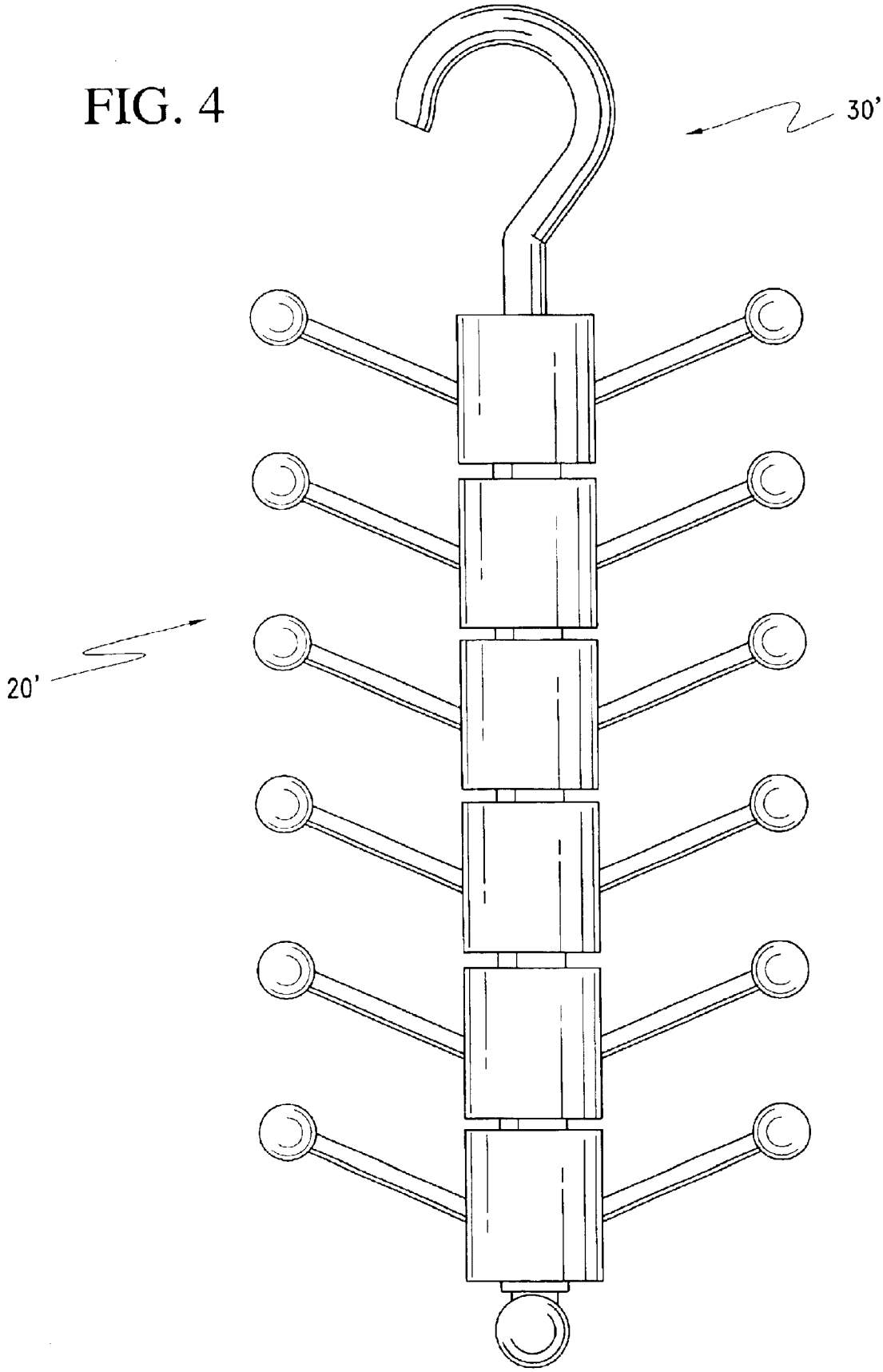
FIG. 4 reveals a frontal view of the spiral tie rack according to the second preferred embodiment of the invention when the pole segment are separated so that the apparel support arms lie flat for packaging.

Referring now to FIGS. 2 and 4, there is shown a second preferred embodiment of the invention which includes an elongate supporting member 30' that carries a stack of six identical or substantially identical pole segments 40'. The annular pole segments 40' each carry a pair of diametrically opposed, upwardly angled, generally radially extending apparel support arms 44'. The manner in which the annular pole segments 40' are rotationally interlocked together on the supporting member 30' in phase-shifted relationship is identical to that described with reference to the first preferred embodiment of the invention.

Other features, including the assembly, use, and packaging of the spiral rack according to the second preferred embodiment of the invention, are identical, substantially identical, or similar to those described in conjunction with the first preferred embodiment of the invention.

Referring now to FIG. 11, there are shown modified male and female coupling parts MC", FC" which are disposed at the lower and upper surfaces 42*l*", 42*u*", respectively, of the modified pole segments 42" according to a third preferred embodiment of the invention. Specifically, the modified male coupling part MC" has a resiliently flared tip T which is adapted to snap into an undercut recess that defines the modified female coupling part FC". That is, upon assembly, the flared tip T is stressed and compressed as it is urged past an annular ledge L which circumscribes and partially covers the undercut recess of the modified female coupling part FC"; thereafter, as the modified male coupling part MC" fully enters the modified female coupling part FC", the flared tip T returns substantially to its unstressed shape, and the annular ledge L substantially inhibits or limits withdrawal of the flared tip T of the modified male coupling part MC" from the undercut recess of the modified female coupling part FC" and the consequential separation of the adjacent modified pole segments 42". As such, the modified male and female coupling parts MC", FC" function as axially acting snap-connections between adjacent ones of the modified pole segments 42". (The modified pole segments 42" are otherwise identical in structure and function to the pole segments 42 described in conjunction with the first preferred embodiment of the invention.) Accordingly, when such modified male and female coupling parts MC", FC" are employed between all pairs of adjacent modified pole segments 42" in a spiral rack (e.g. as in a spiral rack configuration similar to the first preferred embodiment of the invention which includes the modified pole segments 42" of the third preferred embodiment of the invention in place of the pole segments 42), together they function as a limiting means for limiting an upward (e.g. in FIG. 1) movement of the individual modified pole segments 42" away from each other.

Referring now to FIG. 12, there is shown a fourth preferred embodiment of the invention in which the limiting means for limiting an upward movement of the individual pole segments away from each other is formed (or provided) on the elongate supporting member 30. Specifically one or more downwardly angled, flexible one-way extension 38 is provided on the elongate supporting member adjacent (i.e. below) a base part of the curved hook portion 32 and slightly above a ultimate vertical position of the upper surface of the top pole segment. The flexible one-way extension(s) 38 permit(s) the pole segments 40 to be slipped around the curved hook portion 32 and moved downwardly onto the core portion 34 from the top during assembly, but prevent(s) movement of the top pole segment 42 (or consequently any other pole segment) upwardly toward the curved hook portion 32 (e.g. away from the underlying pole segments) after assembly.

Referring now to FIG. 13, there is shown a manner in which the radially extending stop 36 is removably fixed to a lower part 34*a* of the core portion 34 so as to permit loading of the pole segments onto the core portion 34 from the bottom by temporarily removing the stop. In particular, the lower part 34*a* of the core portion 34 is provided with external threads ET, and complementary internal threads IT are formed in a recess provided in the radially extending stop 36. The radially extending stop 36 is removed from and reattached to the lower part 34*a* of the core portion 34 by unscrewing and screwing motions, respectively. Of course, other types of mechanical connection means (such snap-connections) could be employed to removably attach the radially extending stop 36 to the lower part 34*a* of the core portion.

Figure 14A:
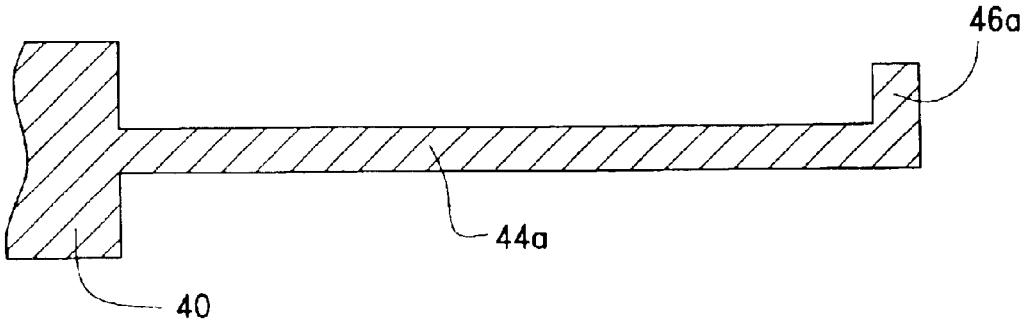
FIGS. 14*a*, 14*b*, and 14*c* reveal part-sectional views of modified versions of the apparel support arms which may be employed with the pole segments of the spiral rack according to any of the preferred embodiments of the invention.
Figure 14B:
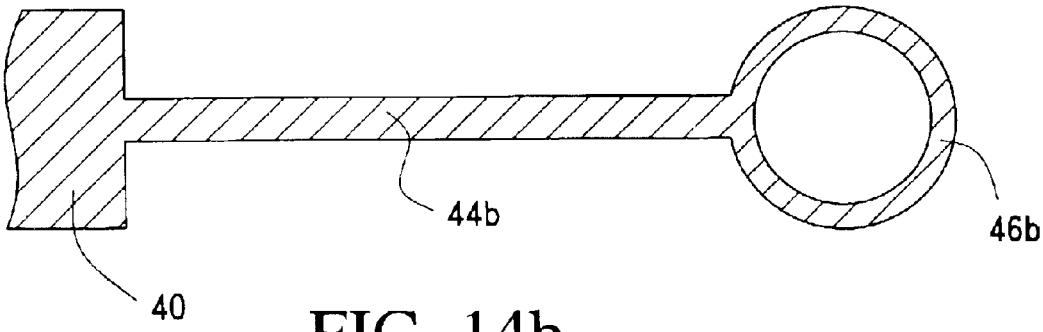
Figure 14C:
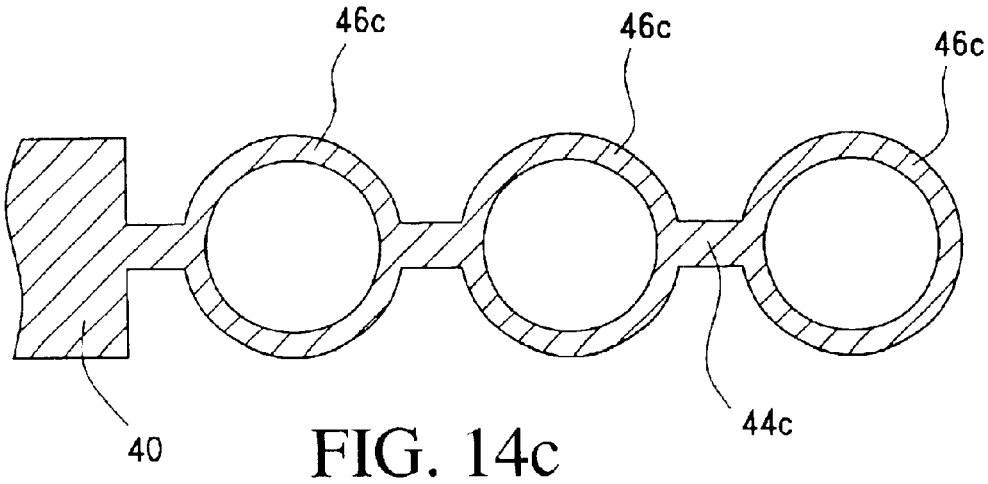

Referring now to FIGS. 14*a*, 14*b*, and 14*c*, there are shown modified versions of (apparel) support arms which may be employed with the pole segments according to any of the previous preferred embodiments of the invention. Specifically, in FIG. 14*a*, the pole segment 40 includes a pair of (diametrically-opposed) generally radially extending apparel support arms 44*a* (only one is shown) that each terminate at a small extension 46*a* which rises perpendicularly from the apparel support arm. In FIG. 14*b*, the pole segment 40 includes a pair of (diametrically-opposed) generally radially extending support arms 44*b* (only one is shown) that each terminate at a ring 46*b* of suitable (e.g. 1") inner diameter. The ring 46*b* is employed to accommodate items (including e.g. non-apparel items) such as scarves, handkerchiefs, and other personal accessories by passing the items partly through the ring 46*b*. In FIG. 14*c*, the pole segment 40 includes a pair of (diametrically-opposed) generally radially extending support arms 44*c* which are each formed integrally as a series of rings or ringlets 46*c*. The rings 46*c* may be used to hang scarves, handkerchiefs, and other personal accessories.

Referring now to FIGS. 15*a* to 15*d*, there is shown a modular base ring connector system (referred to herein as the BRC system) which is used to convert a spiral rack with stacked pole segments between standing, hanging, and wall-mounted configurations.

Figures 15A, 15B, 15C, 15D:
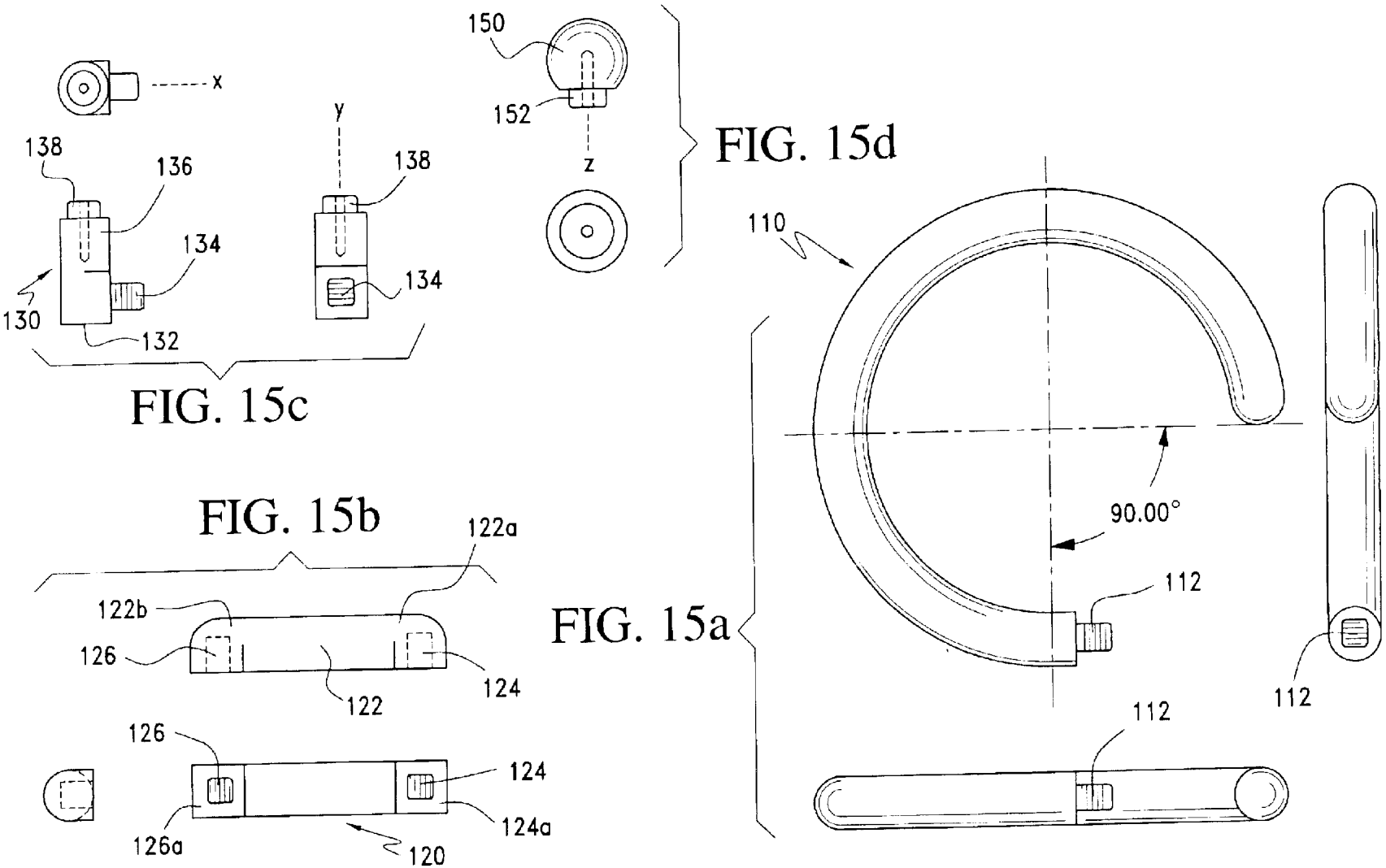
FIGS. 15*a*, 15*b*, 15*c*, and 15*d* reveal a modular base ring connector (BRC) system which may be used with the spiral rack according to any of the preferred embodiments of the invention.

The BRC system includes a base or support ring 110 as shown in FIG. 15*a*, a middle connector 120 as shown in FIG. 15*b*, an endpiece connector 130 as shown in FIG. 15*c*, an elongate core (to be described hereinafter), and a stop member 150 as shown in FIG. 15*d*.

In the preferred embodiment, the base or support ring 110 is a partial ring or toroid which extends through approximately 270 degrees and resembles the curved portion of a hook-like body. A male coupling member 112 having a substantially square cross-section is provided at one end of the base ring 110.

The middle connector 120 comprises a generally cylindrical body portion including a first end 122*a* provided with a first female coupling member 124 (having a substantially square cross-section) which is adapted to (e.g. frictionally) mate with the male coupling member 112 of the base ring 110 and a second end 122*b* provided with a second female coupling member 126 (having a substantially square cross-section). The coupling members 124, 126 face in substantially the same direction and have connector faces 124*a*, 126*a* which occupy substantially the same plane. Since the middle connector 120 is an intermediate connector with two end coupling members that face in the same direction and occupy substantially the same plane, it will be seen that the middle connector functions similarly to a U-type connector (e.g. such as are conventionally used in pipe joints).

The endpiece connector 130 is a small right-angle type connector including a first end 132 provided with a male coupling member 134 (having a substantially square cross-section) which is adapted to (e.g. frictionally) mate with the second female coupling member 126 of the middle connector and a second end 136 provided with a core receiving portion 138. In the preferred embodiment, the core receiving portion 138 comprises a threaded bore (which is adapted to receive a first threaded end of a substantially rigid elongate core which will be described hereinafter with reference to FIGS. 16*a* and 17*a*). As shown in FIG. 15*c*, the axis X of the male coupling member 134 and the axis Y of the bore of the core receiving portion 138 are disposed substantially at right angles.

The stop member 150 in the preferred embodiment is a small, generally spherical member having a core receiving portion 152 that includes a threaded bore. The threaded bore is adapted to receive a second threaded end of the elongate core which will be described with reference to FIGS. 16*a* and 17*a*). While the stop member is shown as a spherical member, other shaped may be employed; however, in any event, a cross-sectional dimension of the stop member 150 (i.e. in a direction perpendicular to the axis Z of the bore) is greater than the diameter of the central openings O of the stacked pole segments with which the stop member 150 is intended to be used.

Figure 16A:
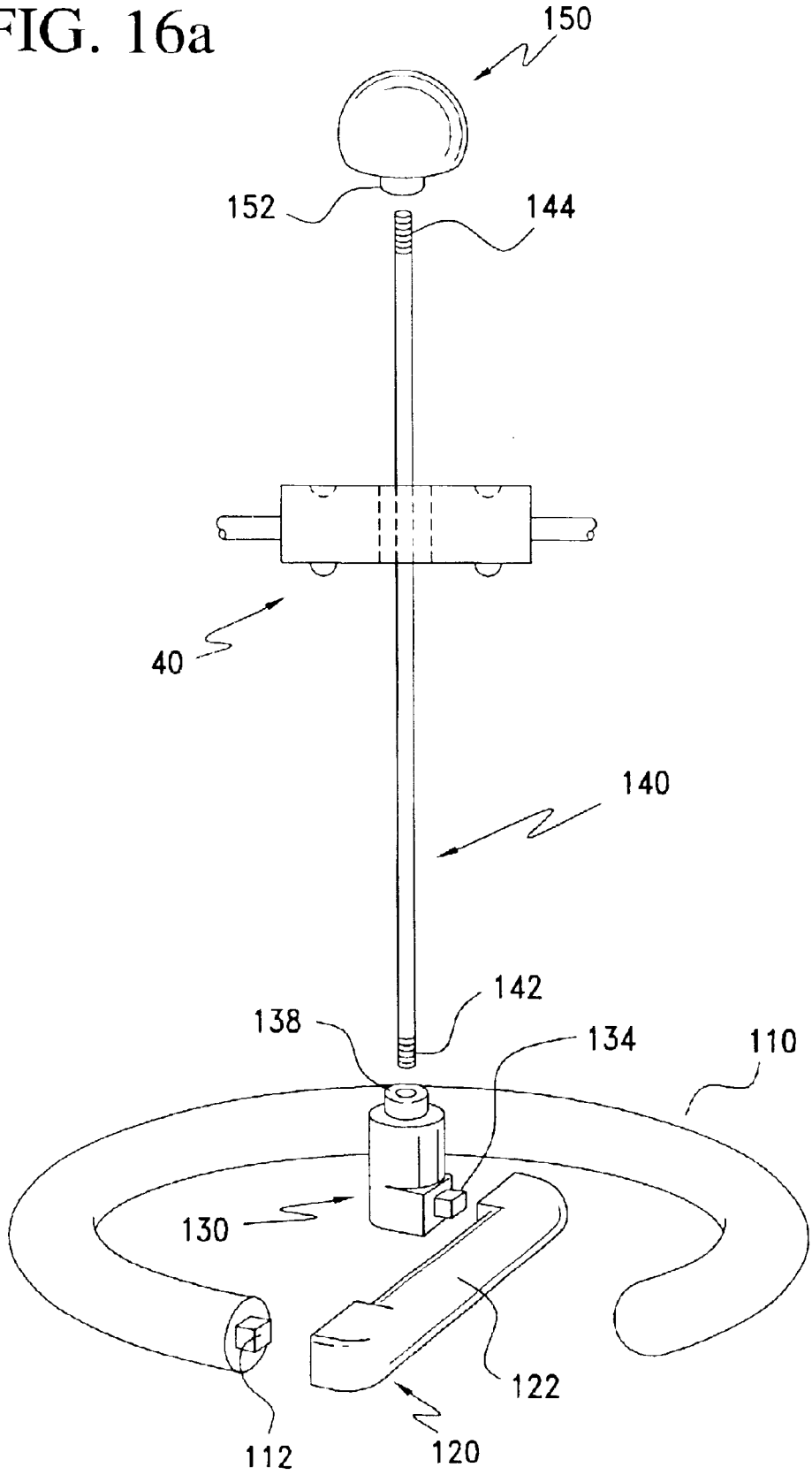
FIG. 16*a* reveals the BRC system configured for a standing spiral rack.
Figure 16B:
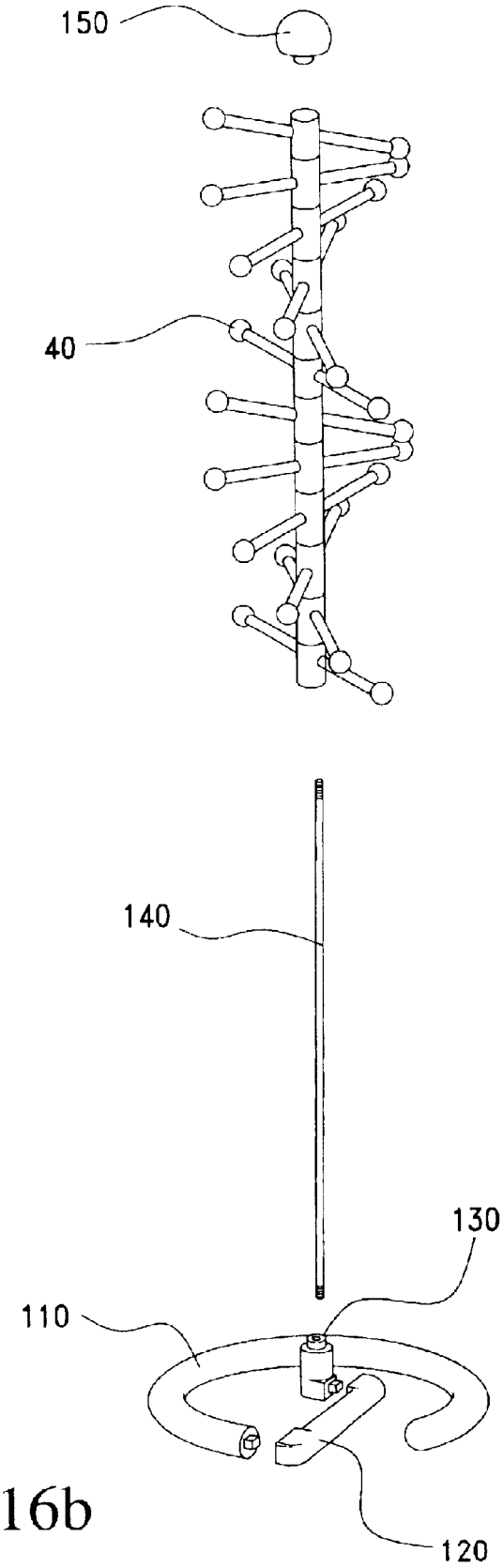
FIG. 16*b* shows an exploded view of a standing rack having the BRC system and the stacked pole segments.

FIGS. 16*a* and 16*b* reveal (in exploded views) the BRC system configured to support a standing or table-top spiral rack. The base ring 110 rests on a support surface (not shown). The middle connector 120 is (e.g. frictionally) connected to and extends radially inwardly from the male coupling member 112 of the base ring 110, and the endpiece connector 130 is (e.g. frictionally) connected to and extends upwardly from the inward end of the middle connector 120. The elongate core 140 includes a first threaded end 142 which is threadingly received within the core receiving portion 138 of the endpiece connector 130 and a second threaded end 144 which is threadingly received within the core receiving portion 152 of the stop member 150. A plurality of stacked pole segments 40 are stacked on the elongate core 140 so as to rest on the endpiece connector 130 and form a standing spiral rack. The manner in which the pole segments are stacked and interlocked together, and the manner in which the support arms 44 spiral around the elongate core [portion] has been previously described with reference to the previous preferred embodiments of the invention.

FIGS. 17*a* and 17*b* reveal (in exploded views) the manners in which the BRC system is configured to support a hanging or wall-mounted spiral rack.

In FIG. 17*a*, the base or support ring 110 functions as a hook and is hooked around a closet rod CR or like horizontal rod. The middle connector is (e.g. frictionally) connected to and extends downwardly (i.e. radially outwardly) from the coupling member 112 of the base or support ring 110, and the endpiece connector 130 is (e.g. frictionally) connected to and extends downwardly from the middle connector 130. The first end 142 of the elongate core 140 is threaded into the core receiving portion of the endpiece connector 130, and the second end 144 of the elongate core 140 is threaded into the core receiving portion of the stop member 150. A plurality (e.g. 6 or 12) of stacked pole segments (shown schematically at 40) are stacked on the elongate core 140 so as to rest on the stop member 150 and form a hanging spiral rack. The manner in which the plurality of pole segments in this embodiment are stacked and interlocked together (by the interlocking means), and the manner in which the support arms 44 spiral around the vertical elongate core [portion] has been previously described with reference to the previous preferred embodiments of the invention, and (to avoid undo repetition) specific reference is made to the description of FIGS. 1 to 9 for details on these aspect of the FIG. 17*a* embodiment.

In FIG. 17*b*, the base or support ring 110 is secured to a wall (or other vertical surface, not shown) by means of suitable fasteners F (such as screws which extend through mounting holes provided in the base or support ring). The middle connector 120 extends outwardly (e.g. perpendicularly) from the plane of the base or support ring 110. The endpiece connector 130 extends downwardly from the middle connector, and the elongate core 140 is connected to and extends downwardly from the endpiece connector 130 (in the manner previously described) and terminates at the stop member 150. A plurality of stacked pole segments (shown schematically at 40) are stacked on the elongate core 140 so as to rest on the stop member 150 and form a hanging spiral rack. The manner in which the pole segments are stacked and interlocked together, and the manner in which the support arms 44 spiral around the vertical elongate core [portion] has been previously described with reference to the previous preferred embodiments of the invention.

Regarding the BRC system, the male and female coupling members of the base ring 110, the middle connector 120, and the endpiece connector are preferably configured as "friction fit" coupling members. However, other means for securing the mated members together (such as adhesives) may also be employed. Additionally, except as particularly stated in the appended claims, no limitation is intended or implied regarding whether individual coupling members of the BRC system are male or female, or whether they are hermaphroditic or otherwise; however, male connectors when used should be mated with female connectors. Moreover, except as particularly stated in the appended claims, no limitation is intended or implied regarding the cross-sectional shapes of the coupling members of the BRC system. The coupling members could be triangular, octagonal, etc. in cross-sectional shape, so long as the coupling member 112 of the curved base ring 110 and the first coupling member 124 of the middle connector 120 are capable of mating in at least three different relative orientations, and so long as the second coupling member 126 of the middle connector 120 and the coupling member 134 of the endpiece connector 130 are capable of mating in at least two different relative orientations, whereby the base ring 120 may be positioned relative to the elongate core 140 so as to facilitate table-top mounting, rod mounting, and wall-mounting of the rack.

FIGS. 18*a* and 18*b* reveal unitary pole segments and support arm elements 160 which are particularly useful when a spiral rack according to the invention is configured as a standing rack intended for use as a jewelry organizer. Particularly, each of the opposing pair of support arms 162 is provided with a plurality of upwardly opening slots or notches 164. Posts of earrings having posts (pierced earrings) may be positioned within the slots or notches 164, with the backings of those earrings being used to hold the earrings in place on the rack (much the same way as when a person is wearing the earrings). Jewelry items (such as necklaces or bracelets) may also be draped over the support arms 162 so as to positioned and held within the slots 164.

Figure 20:
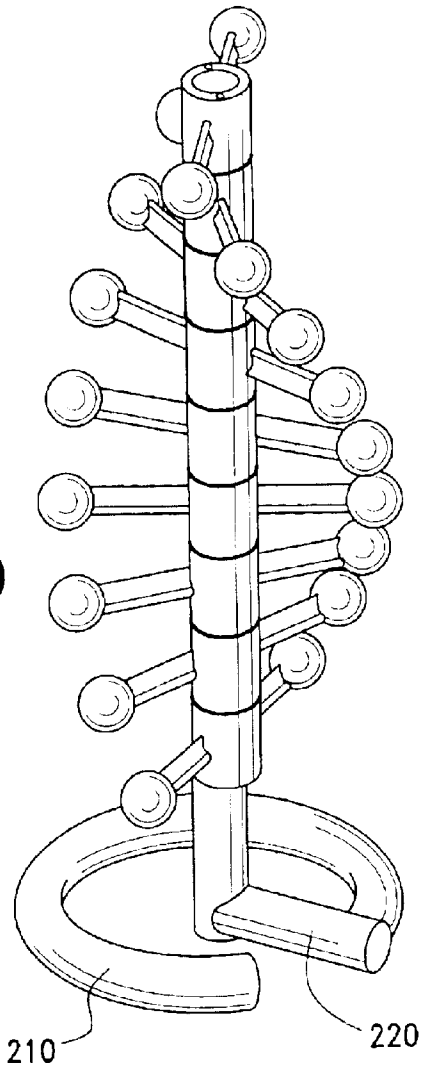
FIG. 20 reveals a standing spiral rack which employs the right-angle connector of FIG. 19*b;*
Figure 19A:
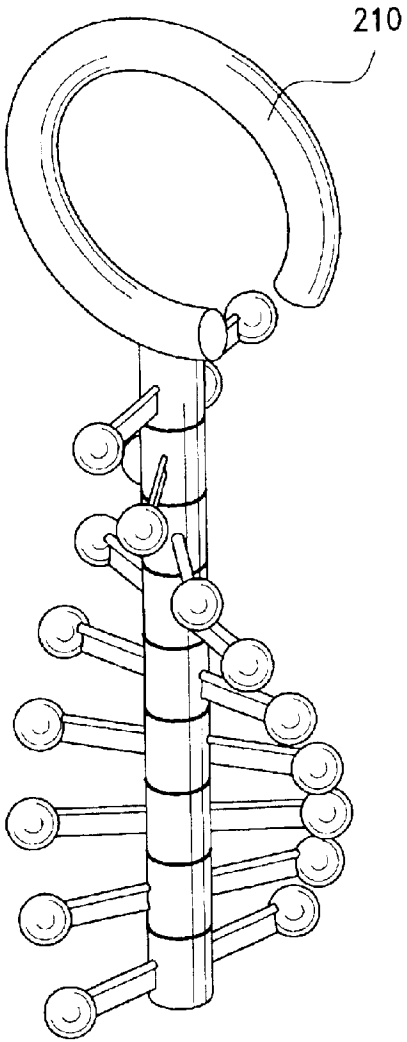
FIG. 19*a* reveals a perspective view of further embodiment of a hanging spiral rack according to the invention.
Figure 19B:
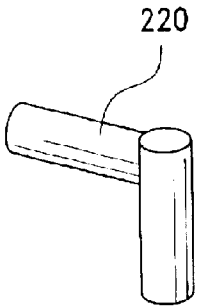
FIG. 19*b* reveals a right-angle connector which may used to convert the spiral rack of FIG. 19*a* into a standing rack or a wall-mounted rack.
Figure 21:
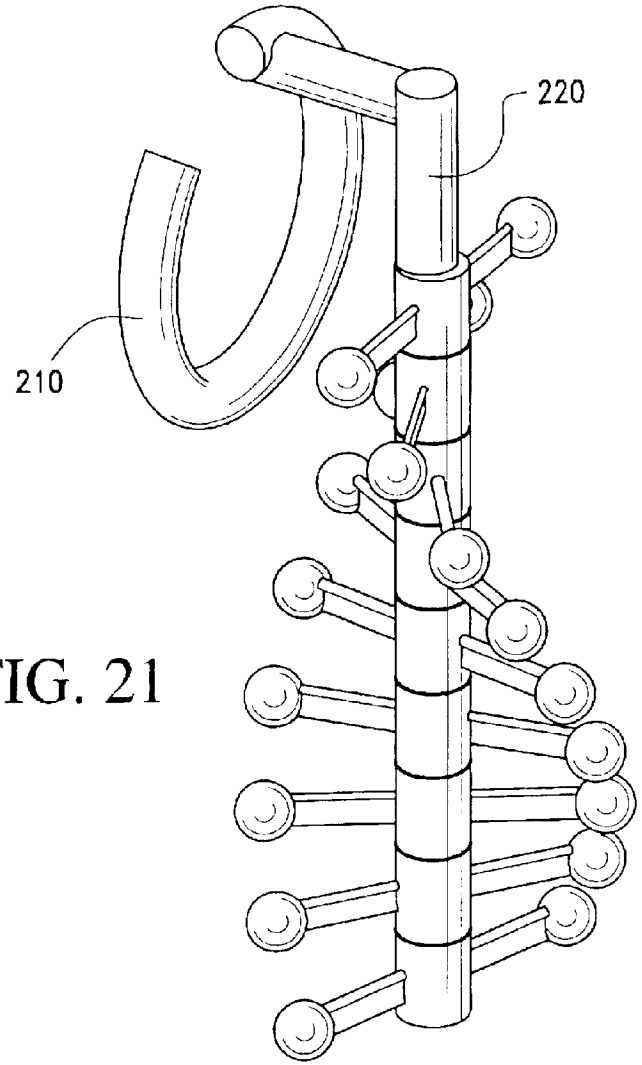
FIG. 21 reveals a wall mounted rack which employs the right-angle connector of FIG. 19*b*.

FIGS. 19*a* and 19*b* reveal a perspective view of another spiral rack according to the invention. In FIG. 19*a*, a partial ring 210 is connected directly to a central elongate core (not shown, around which the pole segments are disposed) by suitable means such as adhesives to form a hanging spiral rack. FIG. 19*b* shows a right-angle connector 220 which can be added (e.g. during manufacture) to the spiral rack of FIG. 19*a* to convert the spiral rack to a standing or wall-mounted rack, as shown in FIGS. 20 and 21, respectively. The right-angle connector 220 may be securely interposed between and fixed to the partial ring 210 and the central elongate core (not shown) by suitable means such as adhesives.

Figure 22:
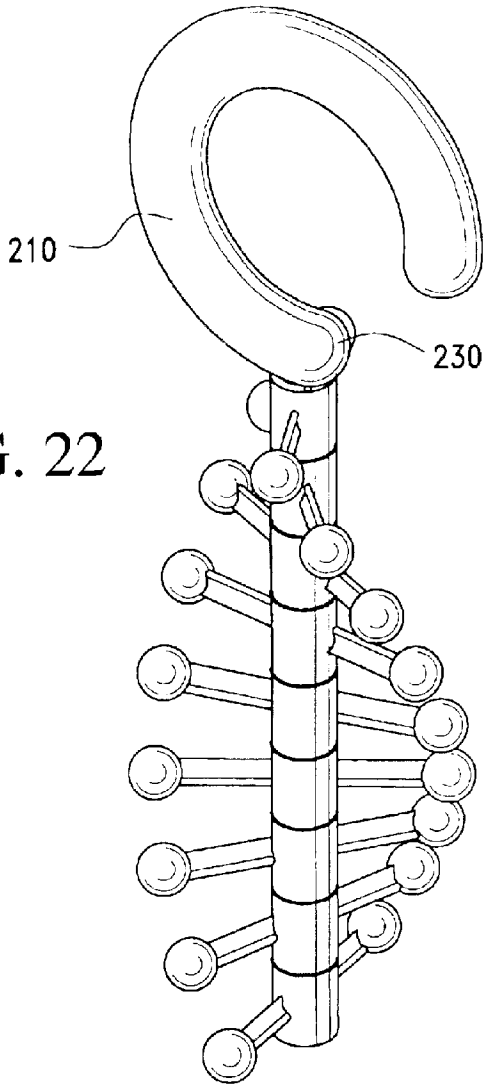
FIG. 22 reveals a perspective view of a still further embodiment of a hanging spiral rack according to the invention.

As shown in FIG. 22, the partial ring 210 may also be secured to the central elongate core (not shown) by means of mechanical fasteners such as a pin joint 230.

As used herein, the phrase "personal accessories" shall encompass items primarily intended to be worn or carried by a person (such as ties, belts, watches, jewelry, barrettes, hair bands), but it shall not encompass Christmas decorations of the kind disclosed in German published application DE 3339740 which are apparently not primarily meant to be worn or carried by a person, but which are impersonal in nature.

While the invention has been described with certain particularity, it is not meant to be limited to the above described preferred embodiments. For example, the radially extending stop 36 could be replaced with another mechanical structure for supporting the stack of pole segments 40 against the force of gravity (such as an inwardly extending feature on the lowermost pole segment which engages a groove provided at the lower part 34*a* of the core portion 34). The curved hook portion 32 could be replaced with another mechanical structure (i.e. a top mounting portion such as a bracket) for connecting the top of the rack (e.g. the top of the core portion 32) to an external support structure in such a manner that the stack of pole segments can be rotated relative to the core portion 32. The positions of the (free ends of the) apparel or accessory support arms 44 around the core portion 34 need not form an exact spiral, but may form other geometric shapes (e.g. a helical zig-zag which goes up and down, alternately, as it traverses the circumference of the rack). The pole segments be rotationally fixed together by using annular gear-shaped projections (that are arranged coaxially with the annular body portions) which interfit with phase-shifted annular gear-shaped recesses. Therefore, the present invention will encompass the above described preferred embodiments as well as any other modifications and equivalents thereof which will fall within the scope of the appended claims.

I claim:

1. A rack for supporting personal accessories, comprising:

a base ring having a coupling member at one end thereof;

a middle connector having a first end provided with a first coupling member that mates with the coupling member of the base ring, and a second end provided with a second coupling member;

an endpiece connector having a first end provided with a coupling member that mates with the second coupling member of the middle connector, and a second end provided with a core receiving portion;

an elongate core having a first end received and held by the core receiving portion of the endpiece connector, and a second end;

a plurality of annular pole segments, each of the pole segments carrying at least one personal accessory support arm that includes a free end, wherein the pole segments are rotatably received on the elongate core in a stacked manner;

a stop member connected to the second end of the elongate core in such a manner that the pole segments are disposed on the elongate core between the endpiece connector and the stop member;

and wherein the rack further comprises:

interlocking means provided on the pole segments for rotationally interlocking the pole segments together in a such a manner that the free ends of the personal accessory support arms spiral at least partly around the elongate core.

2. The rack as recited in claim 1, wherein the coupling member of the base ring and the first coupling member of the middle connector are capable of mating in at least three different relative orientations, and wherein the second coupling member of the middle connector and the coupling member of the endpiece connector are capable of mating in at least two different relative orientations, whereby the base ring may be positioned relative to the elongate core so as to facilitate table-top mounting, rod mounting, and wall-mounting of the rack.

3. The rack as recited in claim 2, wherein all of the coupling members in the rack are configured as either male or female, wherein each of the male coupling member in the rack mates with a corresponding one of the female coupling members in the rack, and wherein all of the cross-sections of the male and female coupling members in the rack are square.

4. A rack comprising:

a base ring;

an elongate core;

connecting means interconnecting the base ring and the elongate core; and a plurality of annular pole segments, each of the pole segments comprising upper and lower surfaces and carrying two diametrically opposed personal accessory support arm that each include a free end, wherein the pole segments are rotatably received on the elongate core in a stacked manner so that the free ends of the support arms spiral at least partly around the elongate core; and wherein interlocking means, comprising complementary interlocking features, are provided on the upper and lower surfaces of the pole segments for rotatably interlocking the pole segments together in a fixed angular relationship so as to form a unitary stack; and wherein the rack is configured as a standing rack which is supported on the base ring, and wherein the elongate core extends upwardly from the base ring.

5. The rack as recited in claim 4, further including a stop member secured to the elongate core above the plurality of annular pole segments.

6. The rack as recited in claim 4, wherein the connecting means includes: a middle connector connected to the base ring and an endpiece connector connected to the middle connector and to the elongate core.

7. The rack as recited in claim 4, wherein the base ring is a partial ring.

8. The rack as recited in claim 4, wherein the base ring is a partial toroid.

9. A rack comprising:

a base ring in the form of a partial ring;

an elongate core;

connecting means interconnecting the base ring and the elongate core; and a plurality of annular pole segments, each of the pole segments carrying at least one personal accessory support arm that includes a free end, wherein the pole segments are rotatably received on the elongate core in a stacked manner so that the free ends of the support arms spiral at least partly around the elongate core; and wherein the rack is configured as a convertible rack which is adapted to be supported by the base ring in a plurality of mounting configurations including a standing configuration, in which the elongate core extends upwardly from the base ring, and at least one additional mounting configuration selected from the group consisting of:

a rod mounting configuration, in which the base ring is hooked around a horizontal rod; and a wall-mounting configuration, in which fastening means are employed for fastening the base ring to a vertical surface.

10. The rack as recited in claim 9, wherein the connecting means includes: a middle connector connected to the base ring and an endpiece connector connected to the middle connector and to an end of the elongate core.

11. The rack as recited in claim 10, further including a stop member secured to the end of the elongate core opposite the endpiece connector.

12. The rack as recited in claim 7, wherein the rack is configured to be supported by the base ring in a rod-mounting configuration.

13. The rack as recited in claim 10, wherein the rack is configured to be supported by the base ring in a wall-mounting configuration.

14. The rack as recited in claim 9, wherein the base ring is a partial toroid.

15. The rack as recited in claim 9, wherein each of the pole segments comprises and upper surface and a lower surface, and wherein interlocking means, comprising complementary interlocking features, are provided on the upper and lower surfaces of the pole segments for rotatably interlocking the pole segments together in a fixed angular relationship so as to form a unitary stack.

16. The rack as recited in claims 9, wherein interlocking means are provided on the pole segments for rotationally interlocking the pole segments together in a such a manner that the free ends of the support arms spiral at least partly around the elongate core.

17. A rack comprising:

a base ring;

an elongate core;

a middle connector interconnecting the base ring and the elongate core; and a plurality of annular pole segments, each of the pole segments carrying at least one personal accessory support arm that includes a free end, wherein the pole segments are rotatably received on the elongate core in a stacked manner so that the free ends of the support arms spiral at least partly around the elongate core; and wherein the rack is configured as a convertible rack which is adapted to be supported by the base ring in a plurality of mounting configurations selected from the group consisting of a standing configuration, a rod mounting configuration, and a wall-mounting configuration;

wherein the base ring is a partial toroid which extends through approximately 270 degrees.

18. The rack as recited in claim 17, wherein interlocking means are provided on the pole segments for rotationally interlocking the pole segments together in a such a manner that the free ends of the support arms spiral at least partly around the elongate core.

19. The rack as recited in claim 18, wherein the interlocking means comprise interlocking male and female coupling features provided on upper and lower surfaces of the annular pole segments.

* * * * *